US006837414B1

(12) United States Patent
Chou

(10) Patent No.: US 6,837,414 B1
(45) Date of Patent: Jan. 4, 2005

(54) MAGAZINE FOR A POWERED NAIL-DRIVING TOOL

(76) Inventor: Kun-Chuan Chou, No. 3, Alley 2, Lane 214, Peng-Yi Rd., Tai-Ping City, Taichung Hsien (TW)

( * ) Notice: Subject to any disclaimer, the term of this patent is extended or adjusted under 35 U.S.C. 154(b) by 0 days.

(21) Appl. No.: 10/727,375

(22) Filed: Dec. 3, 2003

(51) Int. Cl.[7] ..... B25C 1/04
(52) U.S. Cl. ..... 227/109; 227/120; 227/136
(58) Field of Search ..... 227/109, 120, 227/136, 135, 119

(56) References Cited

U.S. PATENT DOCUMENTS 3,266,697 A * 8/1966 Fiedler ..... 227/120
3,437,249 A * 4/1969 Baum ..... 227/120
3,504,840 A * 4/1970 Wandel et al. ..... 227/130
3,980,179 A * 9/1976 Schrepferman ..... 206/338
4,558,811 A * 12/1985 Klaus ..... 227/116
4,784,306 A * 11/1988 Baum ..... 227/113
5,038,993 A * 8/1991 Schafer et al. ..... 227/120
5,626,274 A * 5/1997 Shkolnikov et al. ..... 227/109
6,655,572 B2 * 12/2003 Amada ..... 227/109

* cited by examiner

*Primary Examiner*—Scott A. Smith
(74) *Attorney, Agent, or Firm*—Christie, Parker & Hale, LLP

(57) ABSTRACT

A magazine includes a feeding tray adapted to be secured to a powered nail-driving tool and to accommodate stacked layers of nails, a gate member slidably disposed on the feeding tray to urge the lowermost layer of nails toward the tool, a nail-supplying member disposed over the feeding tray and having a stacking opening which is communicated with the feeding tray and which receives the layers of nails, and a separating member interposed between the nail-supplying member and the gate member. The separating member is coupled to the gate member so as to be movable therewith away from the stacking opening in a retracting course of the gate member for loading of the nails into the feeding tray, and to be moved underneath the stacking opening in an advancing course of the gate member.

12 Claims, 14 Drawing Sheets

MAGAZINE FOR A POWERED NAIL-DRIVING TOOL

BACKGROUND OF THE INVENTION

1. Field of the Invention

This invention relates to a magazine for a powered nail-driving tool, more particularly to a magazine capable of accommodating stacked multiple layers of nails.

2. Description of the Related Art

Referring to FIGS. 1 and 2, a conventional magazine 15 is shown to be used with a powered nail-driving tool which includes a body 11, a nail feeding seat 12 secured to an end of the body 11, a nail-pressing member 13 disposed at an opposite end of the body 11, a pivot axle 14, and a retaining member 16. The nail feeding seat 12 has a nail outlet 121. The nail-pressing member 13 has a body portion 131 and a pressing plate 132 extending toward the nail outlet 121. The magazine 15 has a sector-shaped cross-section, and has a pivot end 151 which is journalled on the pivot axle 14 such that the magazine 15 is turnable about the pivot axle 14. Four nail-receiving grooves 153 are formed through the magazine 15, and extend radially relative to the pivot end 151. Four retaining holes 154 are formed in a retaining end 152 of the magazine 15 adjacent to the body portion 131 for engaging the retaining member 16.

In use, stacks of nails (not shown) are placed into the nail-receiving grooves 153, respectively. The magazine 15 is turned about the pivot axle 14 such that one of the nail-receiving grooves 153 is registered with the nail outlet 121 and the pressing plate 132, and such that the retaining member 16 is engaged with a corresponding one of the retaining holes 154 to retain the magazine 15 in place. When the nails in the selected nail-receiving groove 153 are exhausted, the magazine 15 can be turned again to have another nail-receiving groove 153 registered with the nail outlet 121.

Since the magazine 15 only has four nail-receiving grooves 153, the amount of nails accommodated therein is limited, thereby resulting in inconvenience during use. Moreover, if the selected nail-receiving groove 153 is not registered with the nail outlet 121 precisely, the striking of the nails may be obstructed.

SUMMARY OF THE INVENTION

The object of the present invention is to provide a magazine which is capable of accommodating stacked multiple layers of nails arranged in tandem and which can smoothly urge the loaded nails towards a stroke path of a powered nail-driving tool.

According to this invention, the magazine includes a feeding tray which includes a standby zone adapted to support a lowermost one of the layers of nails that are to be fed into a stroke path of the powered nail-driving tool, and a retreat zone opposite to the standby zone in a longitudinal direction. The feeding tray is adapted to be secured to a powered nail-driving tool such that the longitudinal direction is radial to the stroke path of the powered nail-driving tool in an axial direction, and such that the standby zone and the retreat zone are respectively proximate to and distal from the stroke path. The standby zone extends to terminate at a feeding front edge that is adapted to stop short of the stroke path. The feeding tray further includes a loading zone which is adapted to receive the lowermost one of the layers of nails, which is interposed between the standby zone and the retreat zone, and which has placement and holding areas opposite to each other in the axial direction.

A gate member is slidably disposed on the feeding tray, and is displaceable among the standby zone, the loading zone and the retreat zone such that displacement of the gate member from the loading zone to the retreat zone in a retracting course permits loading of the lowermost one of the layers of nails into the loading zone. The gate member includes pushing and connecting ends opposite to each other in the longitudinal direction. The pushing end is adapted to urge the lowermost one of the layers of nails towards the feeding front edge once loading on the loading zone is completed.

A pull member is disposed to pull the gate member from the standby zone through the loading zone to the retreat zone.

A biasing member is disposed to bias the gate member towards the standby zone to thereby urge a leading one of the nails in the lowermost one of the layers of nails into the stroke path.

A nail-supplying member is disposed over the feeding tray, and has upper and lower wall surfaces opposite to each other in a transverse direction transverse to the axial and longitudinal directions. The upper wall surface defines a stacking opening which extends downward through the lower wall surface so as to be communicated with the feeding tray. The stacking opening is adapted to accommodate the stacked multiple layers of nails, and is registered with the loading zone so as to form a lowering path in the transverse direction.

A separating member is interposed between the nail-supplying member and the gate member, and is movable relative to the nail-supplying member in the longitudinal direction. The separating member is disposed to couple with the gate member so as to be moved therewith in an advancing course, where the gate member is displaced from the loading zone to the standby zone to urge the lowermost one of the layers of nails to the standby zone, and in the retracting course of the gate member. The separating member is configured such that during the retracting course of the gate member, the separating member is moved with the gate member away from the lowering path to the retreat zone, and such that during the advancing course, the separating member is brought to move with the gate member so as to slide underneath and support the remaining layers of nails in place of the gate member that supports the remaining layers of nails when in the loading zone.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
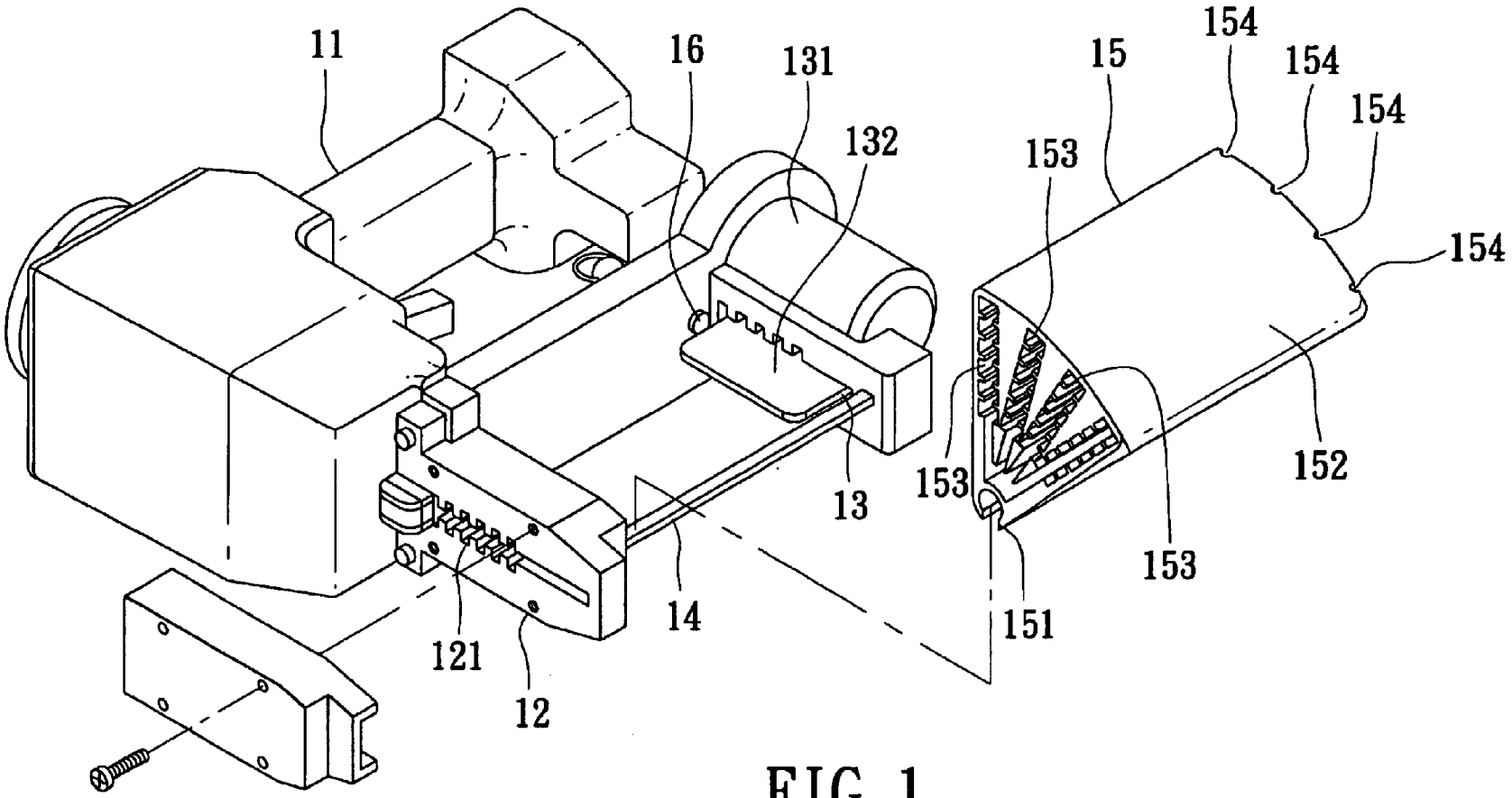
FIG. 1 PRIOR ART
FIG. 1 is an exploded perspective view of a conventional powered nail-driving tool and a magazine for use therewith.
Figure 2:
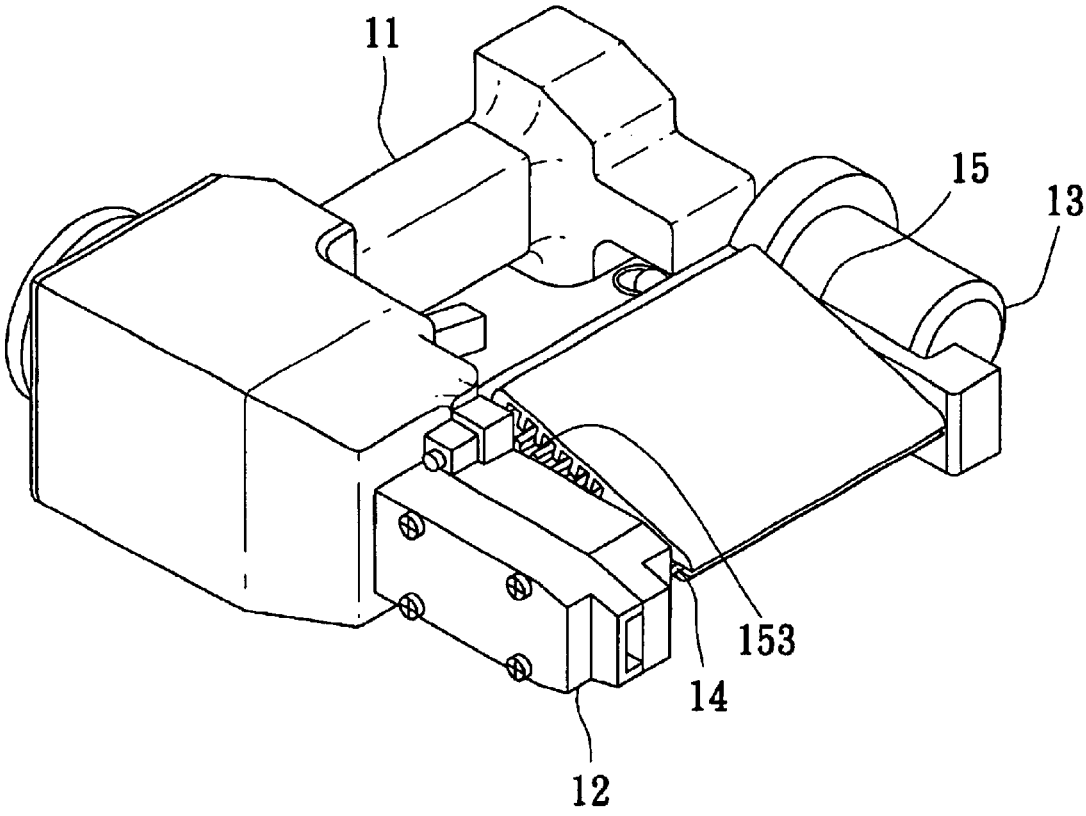
FIG. 2 PRIOR ART
FIG. 2 is a perspective view of the conventional powered nail-driving tool with the magazine mounted thereon.

Before the present invention is described in greater detail, it should be noted that same reference numerals have been used to denote like elements throughout the specification.

Figure 3:
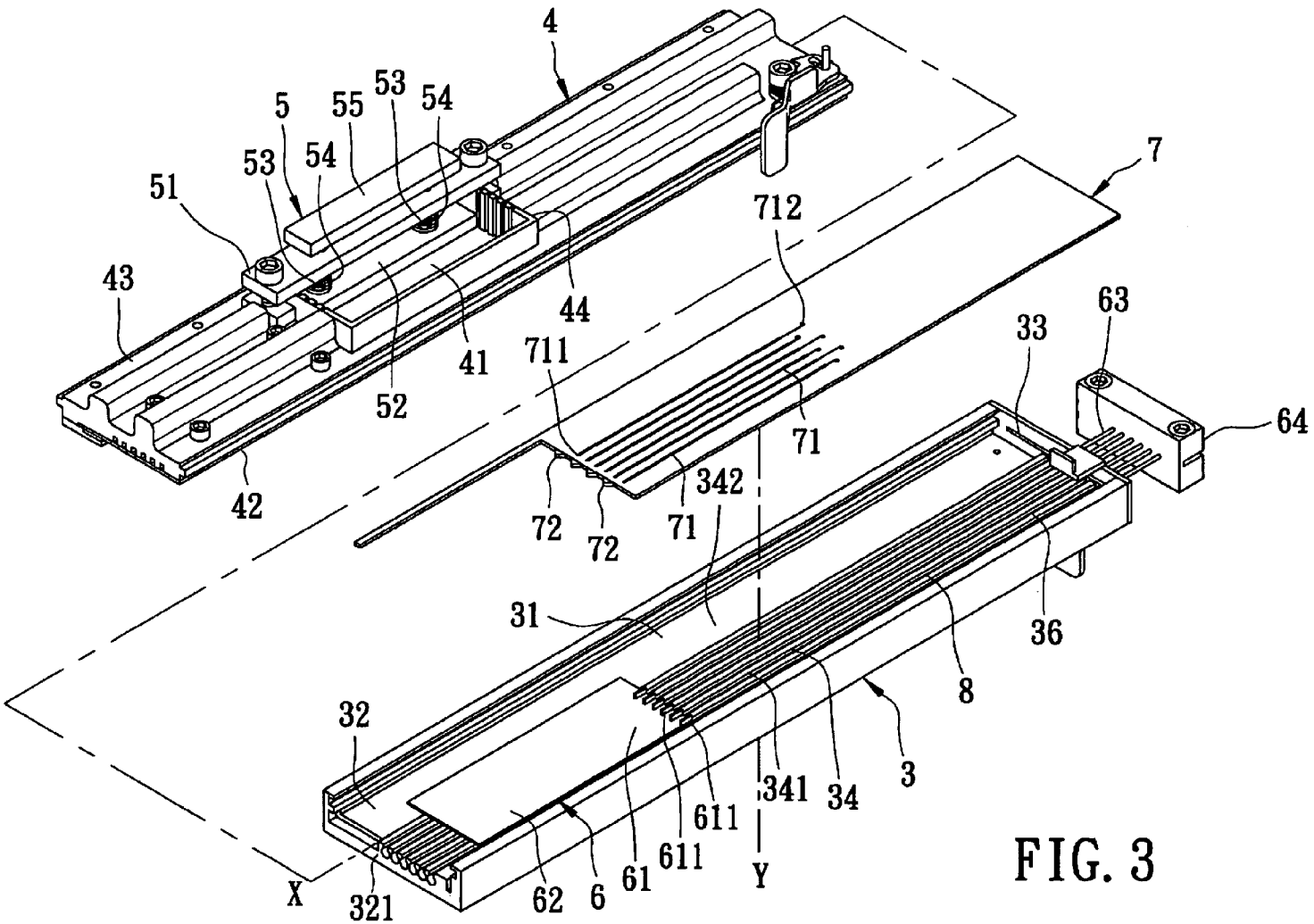
FIG. 3 is an exploded perspective view of the first preferred embodiment of a magazine according to this invention.
Figure 4:
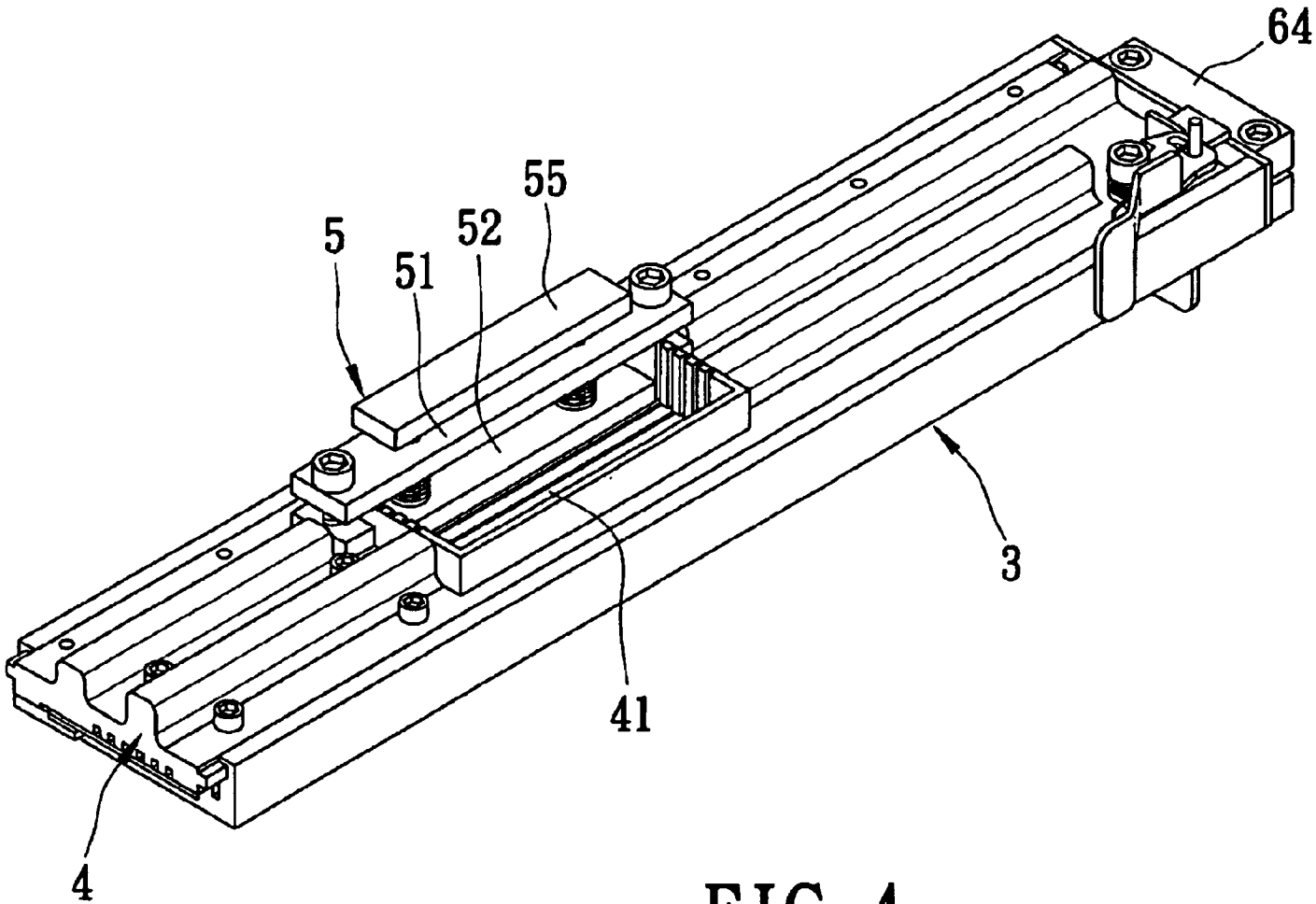
FIG. 4 is a perspective view of the first preferred embodiment.

Referring to FIGS. 3 and 4, the first preferred embodiment of a magazine according to the present invention is used with a powered nail-driving tool (not shown) which defines a stroke path in an axial direction so that a nail that is fed thereinto is impacted along the stroke path. Since the construction of the powered nail-driving tool is a hitherto known type, a description thereof is dispensed with herein for the sake of brevity. The magazine of this embodiment is adapted for accommodating stacked layers of nails 2 (see FIG. 6). The nails 2 in each layer are arranged in tandem and are preferably collated. The magazine is shown to comprise a feeding tray 3, a gate member 6, a pull member, a biasing member, a nail-supplying member 4, a separating member 7, and a nail-depressing member 5.

Figure 9:
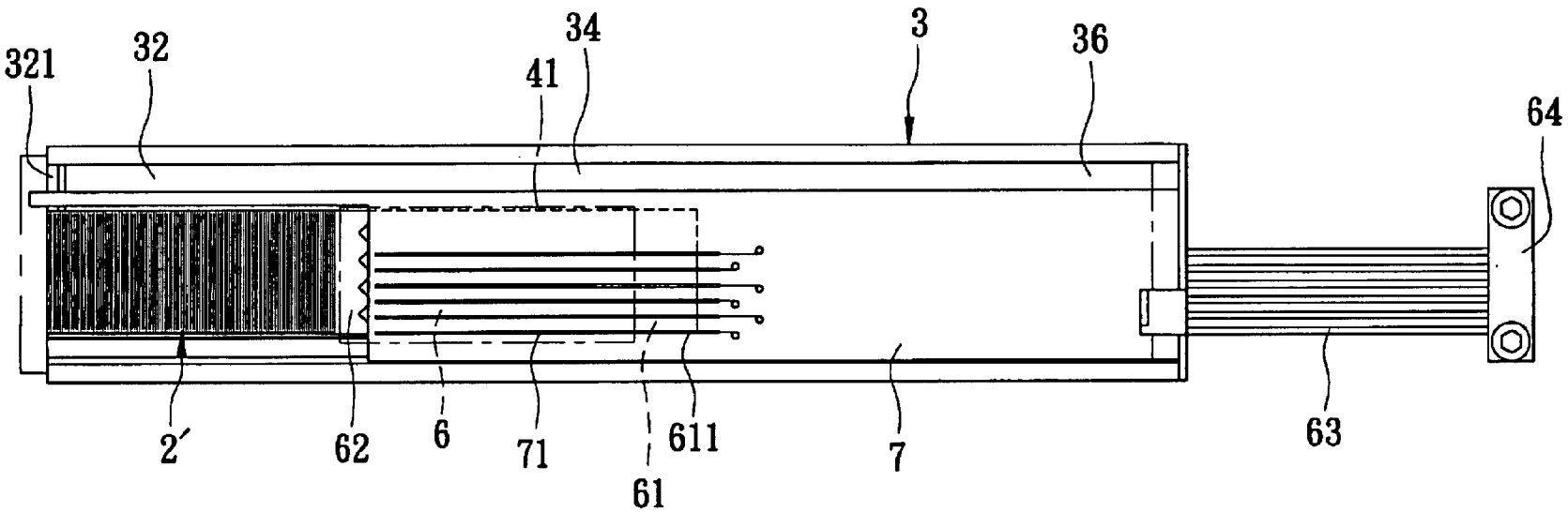
FIG. 9 is a top view of the first preferred embodiment when a pushing end of the gate member urges the lowermost layer of nails.

The feeding tray 3 is formed with an elongated channel 31 which is elongated in a longitudinal direction (X), and which includes a standby zone 32 that is adapted to support a lowermost layer of nails 2' (see FIG. 9), a retreat zone 36 opposite to the standby zone 32 in the longitudinal direction (x), and a loading zone 34 that is interposed between the standby and retreat zones 32,36 and that is adapted for loading the lowermost layer of nails 2'. The feeding tray 3 is adapted to be secured to the powered nail-driving tool such that the longitudinal direction (X) is radial to the axial direction, and such that the standby zone 32 and the retreat zone 36 are respectively proximate to and distal from the stroke path. The standby zone 32 extends to terminate at a feeding front edge 321 that is adapted to stop short of the stroke path. The loading zone 34 has placement and holding areas 341,342 opposite to each other in the axial direction.

Figure 8:
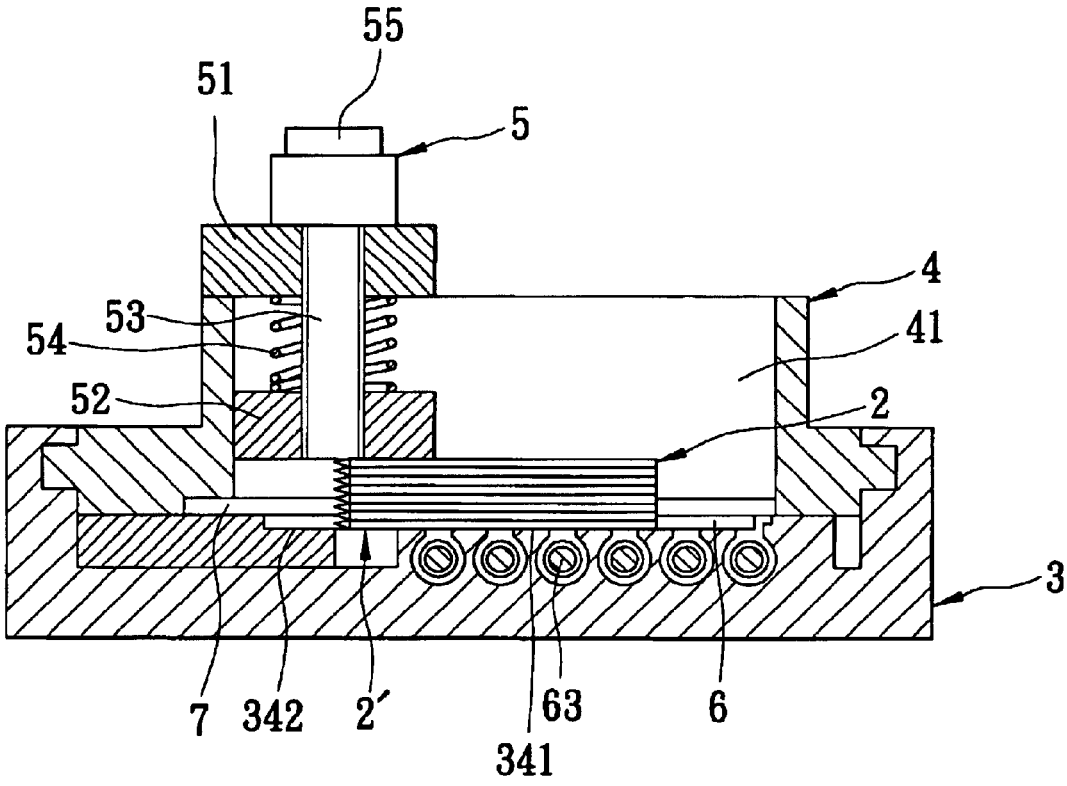
FIG. 8 is a sectional view showing the nail-depressing member depressing the nails when the gate member is in the retreat zone.

The gate member 6 is disposed on the feeding tray 3, and is slidable along the elongated channel 31 so as to be displaceable among the standby zone 32, the loading zone 34 and the retreat zone 36 (see FIG. 8). As such, the displacement of the gate member 6 from the loading zone 34 to the retreat zone 36 in a retracting course permits loading of the lowermost layer of nails 2' onto the loading zone 34. The gate member 6 includes pushing and connecting ends 62,61 opposite to each other in the longitudinal direction (X). The pushing end 62 is adapted to urge the lowermost layer of nails 2' towards the feeding front edge 321 once the loading on the loading zone 34 is completed (see FIG. 9). The connecting end 61 has a plurality of keys 611.

The pull member includes a plurality of connecting rods 63 and an operating block 64. Each of the connecting rods 63 has a first rod end secured to the connecting end 61 of the gate member 6, and a second rod end extending in the longitudinal direction outwardly of the retreat zone 36 and connected to the operating block 64 such that the operating block 64 is operable to pull the gate member 6 to move from the standby zone 32 through the loading zone 34 to the retreat zone 36.

The biasing member includes a plurality of springs 8 which surround the connecting rods 63, respectively, and which are disposed between the connecting end 61 of the gate member 6 and the retreat zone 36 so as to bias the gate member 6 towards the standby zone 32 thereby to urge a leading one of the nails 2' in the lowermost layer into the stroke path.

The nail-supplying member 4 is disposed over the feeding tray 3 in a sliding manner, and has upper and lower wall surfaces 43,42 opposite to each other in a transverse direction (Y) transverse to the axial direction and the longitudinal direction (X), and an inner peripheral wall 44 which extends between the upper and lower wall surfaces 43,42 and which defines a stacking opening 41 that extends downward from the upper wall surface 43 through the lower wall surface 42 so as to be communicated with the feeding tray 3. The stacking opening 41 is adapted to accommodate the stacked layers of nails 2 (see FIG. 6), and is registered with the loading zone 34 so as to form a lowering path in the transverse direction (Y).

Figure 5:
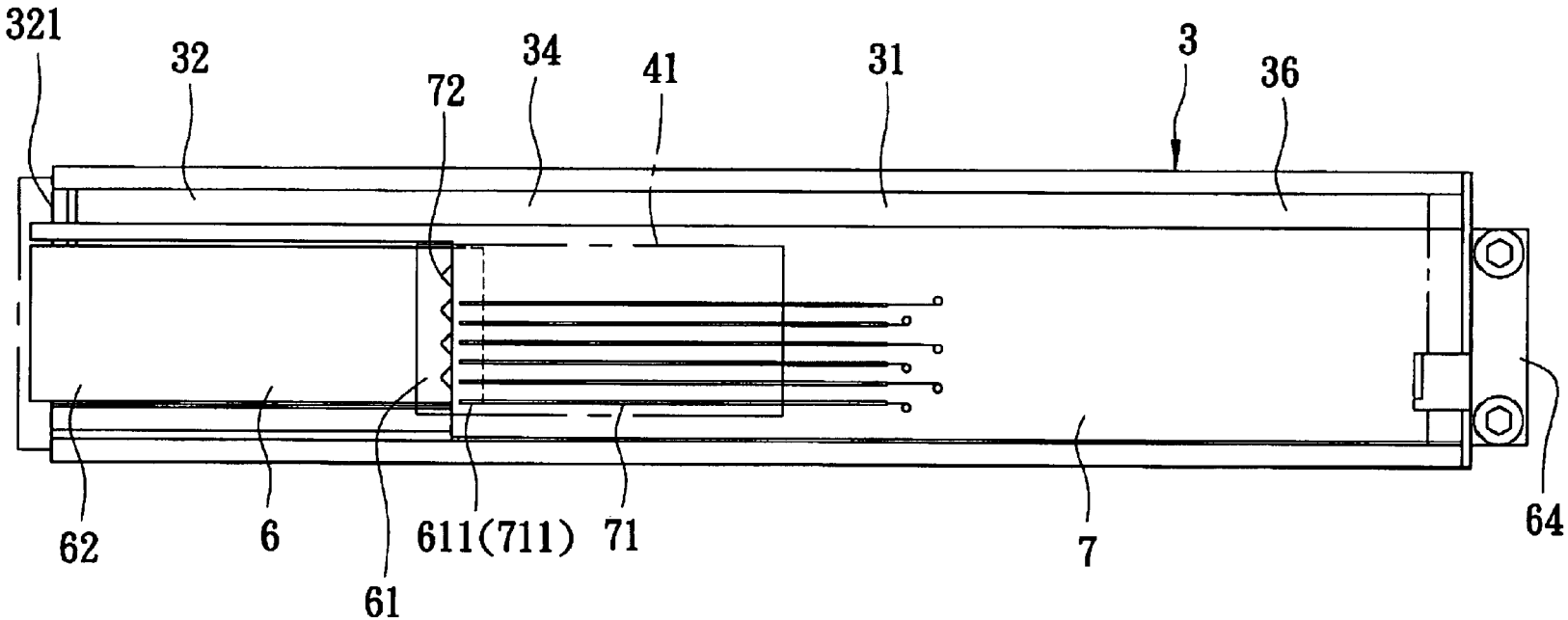
FIG. 5 is a top view of the first preferred embodiment when a gate member thereof is in a standby zone of a feeding tray.
Figure 6:
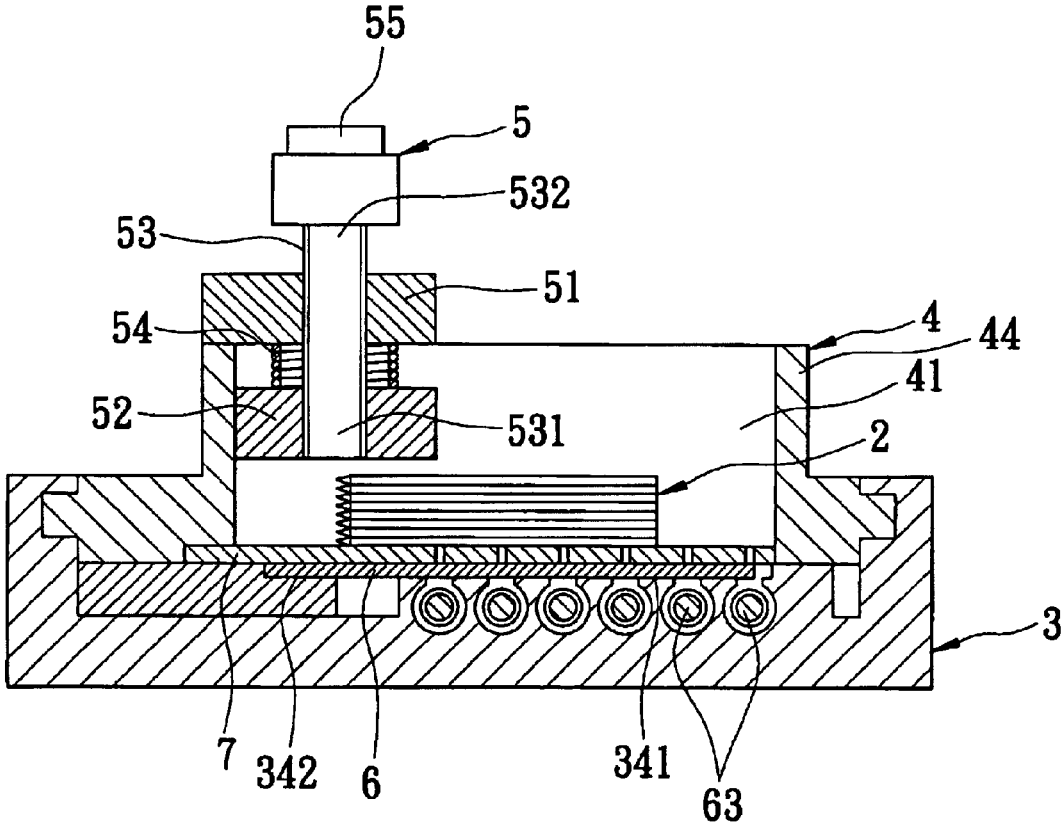
FIG. 6 is a sectional view showing a nail-depressing member of the first preferred embodiment lifted for feeding nails into a stacking opening when the gate member is in the standby zone.
Figure 7:
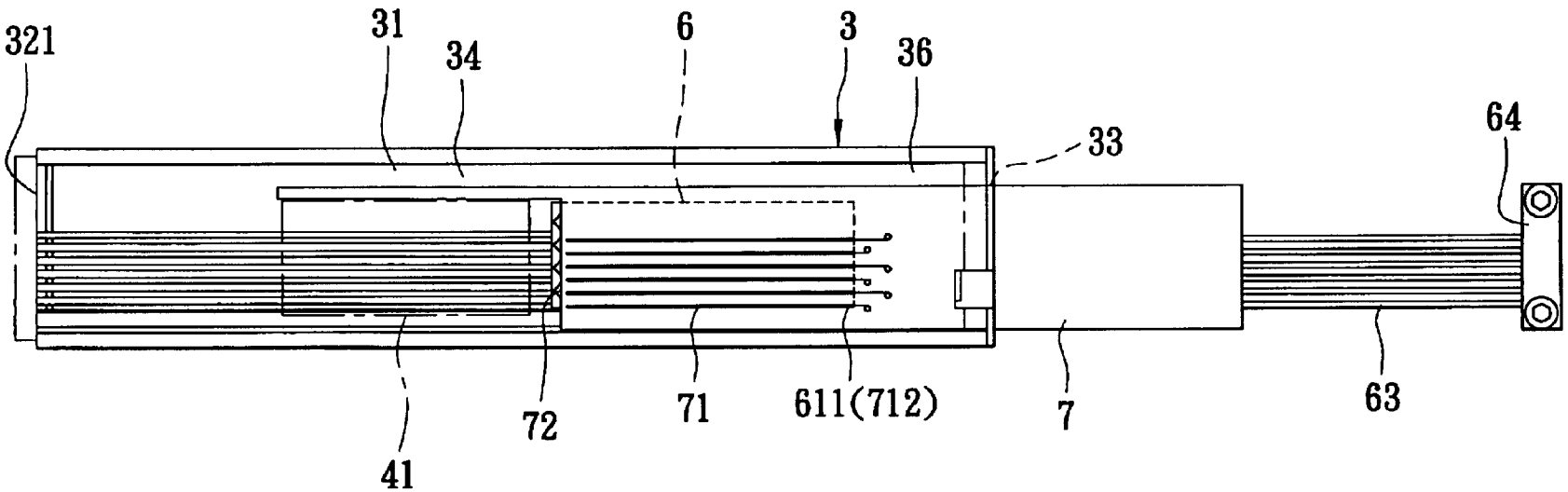
FIG. 7 is a top view of the first preferred embodiment when the gate member is in a retreat zone of the feeding tray.

The separating member 7 is formed as a plate, and is interposed between the nail-supplying member 4 and the gate member 6. The separating member 7 has a plurality of keyways 71 which extend in the longitudinal direction (X), and each of which has first and second limit ends 711,712 respectively proximate to and distal from the feeding front edge 321. The keys 611 of the gate member 6 are disposed in and are slidable along the keyways 71, respectively, such that the separating member 7 is movable with the gate member 6 relative to the nail-supplying member 4 in the longitudinal direction. In particular, when the gate member 6 is displaced from the loading zone 34 to the standby zone 32 in an advancing course, as shown in FIG. 5, the keys 611 reach the first limit ends 711 so that the separating member 7 is disposed underneath the stacking opening 41. During the retracting course of the gate member 6, as shown in FIG. 7, the keys 611 reach the second limit ends 712 so that the separating member 7 is brought to move with the gate member 6 away from the stacking opening 41 to the retreat zone 36, and has a portion thereof exposed outwardly of the feeding tray 3 through a hole 33. In this state, the remaining layers of nails on the separating member 7 can fall into the loading zone 34 below along the lowering path. Moreover, a front edge portion of the separating member 7 adjacent to the first limit ends 711 of the keyways 71 has a plurality of slide inclinations 72 which are inclined from the front edge portion towards the elongated channel 31 so as to stabilize movement of the layers of nails along the lowering path. With reference to FIGS. 3, 4 and 6, the nail-depressing member 5 includes a cover plate 51 which is hinged on the upper wall surface 43 of the nail-supplying member 4 and which turnably covers the holding area 342, a depressing plate 52 which is spaced apart from and which is movable relative to the cover plate 51 in the transverse direction, a pair of stems 53, each of which has a lower end 531 secured to the depressing plate 52, and an upper end 532 extending through the cover plate 51, a pair of biasing members 54 which are disposed between the cover plate 51 and the depressing plate 52 and which respectively surround the stems 53 to bias the depressing plate 52 towards the holding area 342 in the transverse direction so as to bias the depressing plate 52 to the layers of nails 2 in the stacking opening 41, and a pulling plate 55 which is connected to the upper ends 532 of the stems 53 to pull the depressing plate 52 against biasing action of the biasing members 54 away from the holding area 342 for facilitating loading of the nails into the stacking opening 41.

In use, when it is desired to load nails into the magazine, referring to FIG. 6, the pulling plate 55 is pulled upwardly to move the depressing plate 52 away from the separating member 7, thereby permitting loading of nails 2 into the stacking opening 41 in stacked layers. The pulling plate 55 is then released so that the depressing plate 52 presses the stacked layers of nails 2 against the separating member 7. Referring to FIGS. 7 and 8, when the operating block 64 is pulled, the gate member 6 is retracted against the biasing action of the springs 8 so as to move the separating member 7 away from the stacking opening 41, thereby enabling the stacked layers of nails 2 in the stacking opening 41 to fall along the lowering path, with the lowermost layer of nails 2' sliding along the slide inclinations 72 into the loading zone 34 of the elongated channel 31. Finally, referring to FIG. 9, when the operating block 64 is released, the gate member 6, as well as the separating member 7, is moved by the springs 8 to slide along the advancing course toward the standby zone 32 so as to urge the lowermost layer of nails 2' towards the feeding front edge 321 for feeding into the stroke path in a nailing operation. In this state, the remaining layers of nails 2 are on the separating member 7.

After the lowermost layer of nails 2' has been impacted, the gate member 6 is moved back to the standby zone 32 by the springs 8. At this time, the operating block 64 can be operated once again in the aforesaid manner to have the lowermost layer of the stack of remaining nails 2 is disposed in the loading zone 34 for a next nailing operation. Thus, layers of nails 2 can be loaded successively into the standby zone 32 in a convenient manner.

Figure 10:
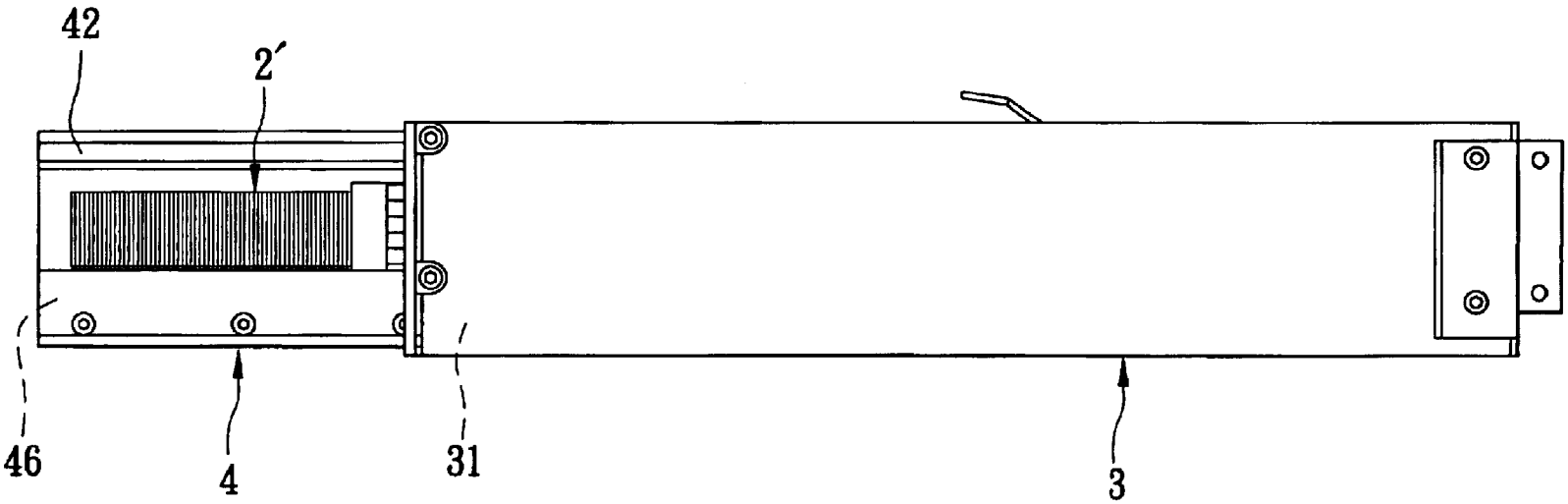
FIG. 10 is a bottom view of the second preferred embodiment of a magazine according to this invention.

Referring to FIG. 10, the second preferred embodiment of a magazine according to this invention is shown to be similar to the first embodiment in construction, except that the lower wall surface 42 of the nail-supplying member 4 is formed with a nail filling groove 46 for accommodating of a single layer of nails 2'. When it is desired to load one single layer of nails 2' into the elongated channel 31, the layer of nails 2' is placed in the nail-filling groove 46, and the nail-supplying member 4 is moved slidably to be disposed over the feeding tray 3. Therefore, a single layer of nails or multiple layers of nails can be selectively loaded into the magazine of this invention as required. Moreover, the nail-supplying member 4 is separable from the feeding tray 3 so as to facilitate removal of jammed nails in the standby zone 32 of the elongated channel 31.

Figure 11:
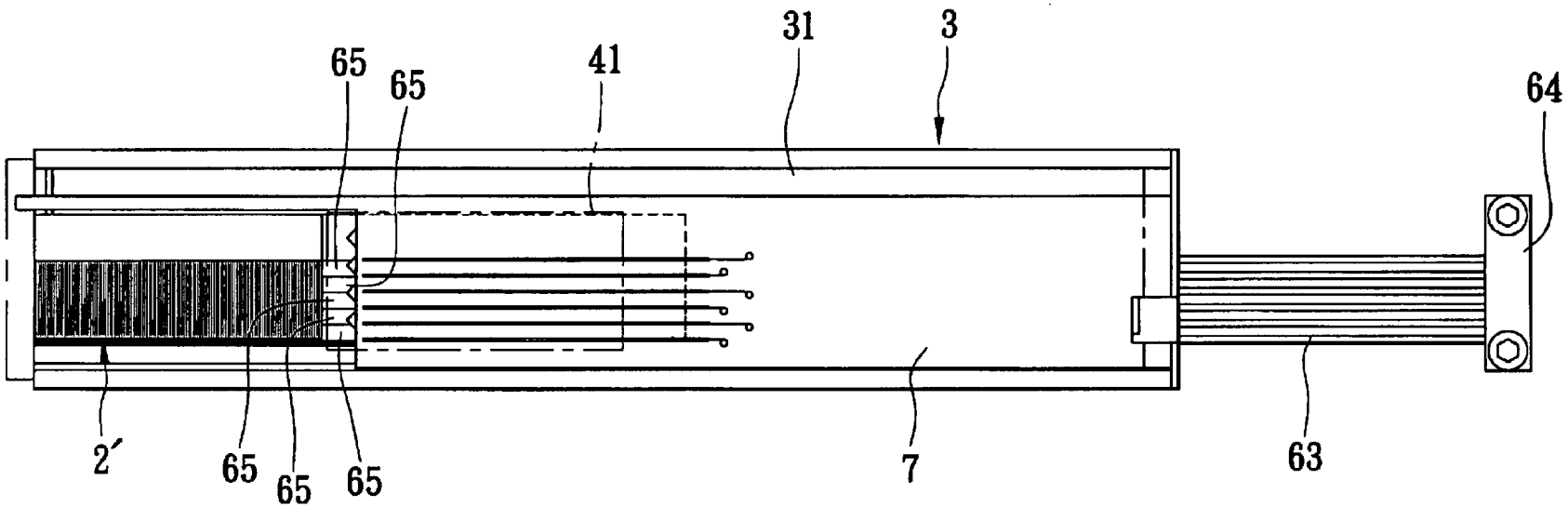
FIG. 11 is a top view of the third preferred embodiment of a magazine according to this invention.

Referring to FIG. 11, the third preferred embodiment of a magazine according to this invention is shown to be similar to the first embodiment in construction, except that the gate member includes a plurality of gate plates 65 extending in the longitudinal direction so as to be connected to the first rod end of a respective one of the connecting rods 63 and to be biased by a respective one of the springs 8 (see FIG. 3). As such, nails 2' of different lengths can be urged by some or all of the gate plates 65.

Figure 12:
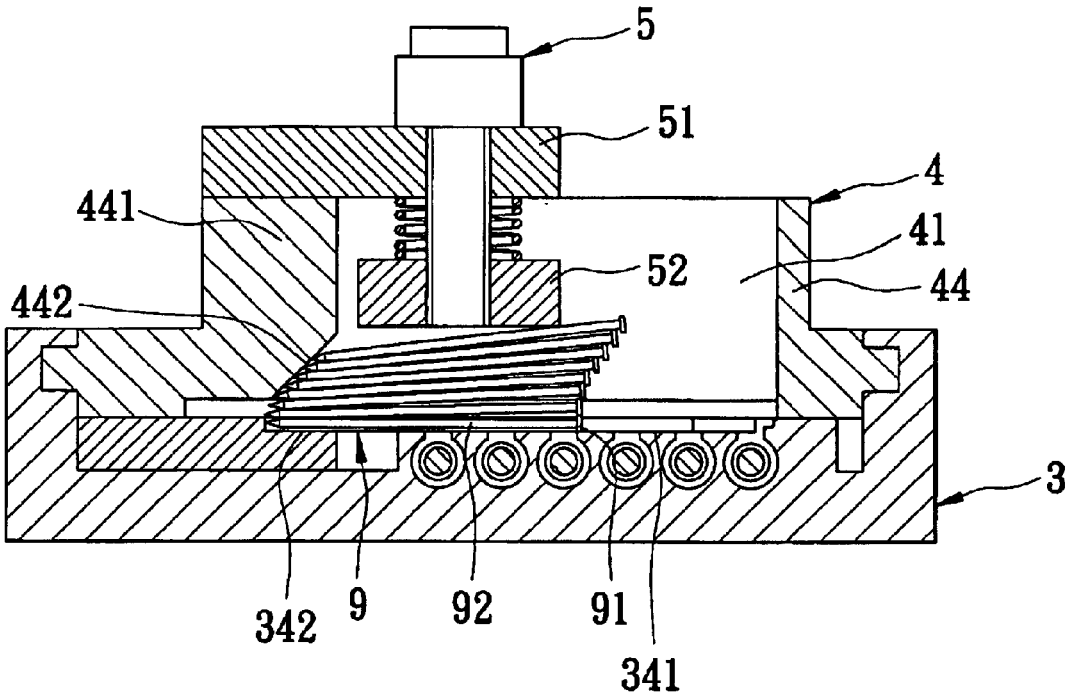
FIG. 12 is a sectional view of the fourth preferred embodiment of a magazine according to this invention.

Referring to FIG. 12, the fourth preferred embodiment of a magazine according to this invention is shown to be similar to the first embodiment in construction, except that the inner peripheral wall 44 of the nail-supplying member 4 has a guiding wall surface 441 which extends from the cover plate 51 toward the holding area 342 and which is distal from the placement area 341 in the axial direction. The guiding wall surface 441 has an abutment region 442 which is inclined towards the holding area 342. As such, the magazine is applicable for holding T-shaped nails 9 each having an enlarged head 91 and a shank 92. That is, during loading of the lowermost layer of nails 9 into the loading zone 34, due to the configuration of the abutment region 442, the remaining layers of nails 9 can be successively shifted back against the abutment region 442 following the inclination of the abutment region 442 while being under the pressure of the depressing plate 52, thereby stabilizing the stacking of the multiple layers of nails 9.

Figure 13:
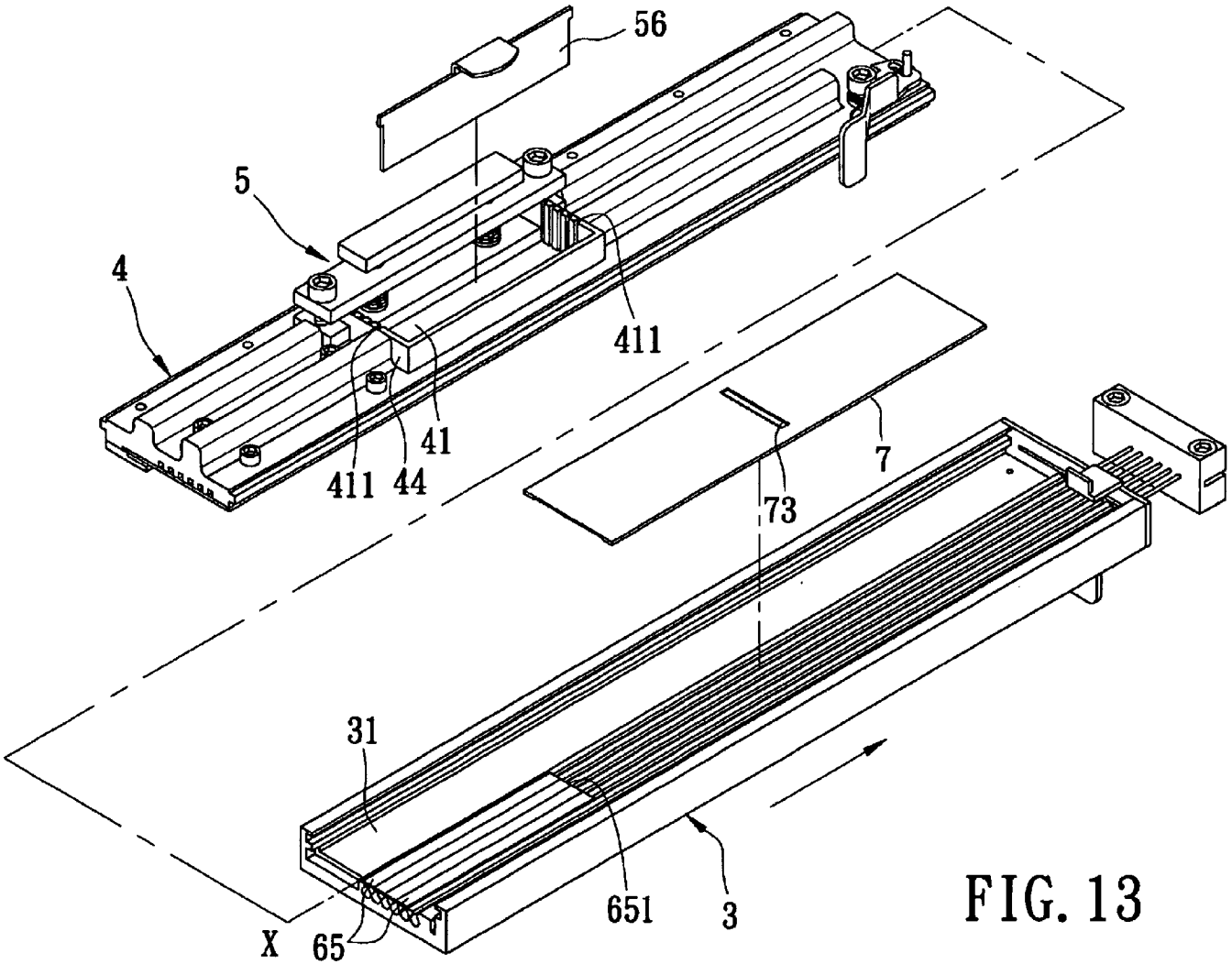
FIG. 13 is an exploded perspective view of the fifth preferred embodiment of a magazine according to this invention.
Figure 14:
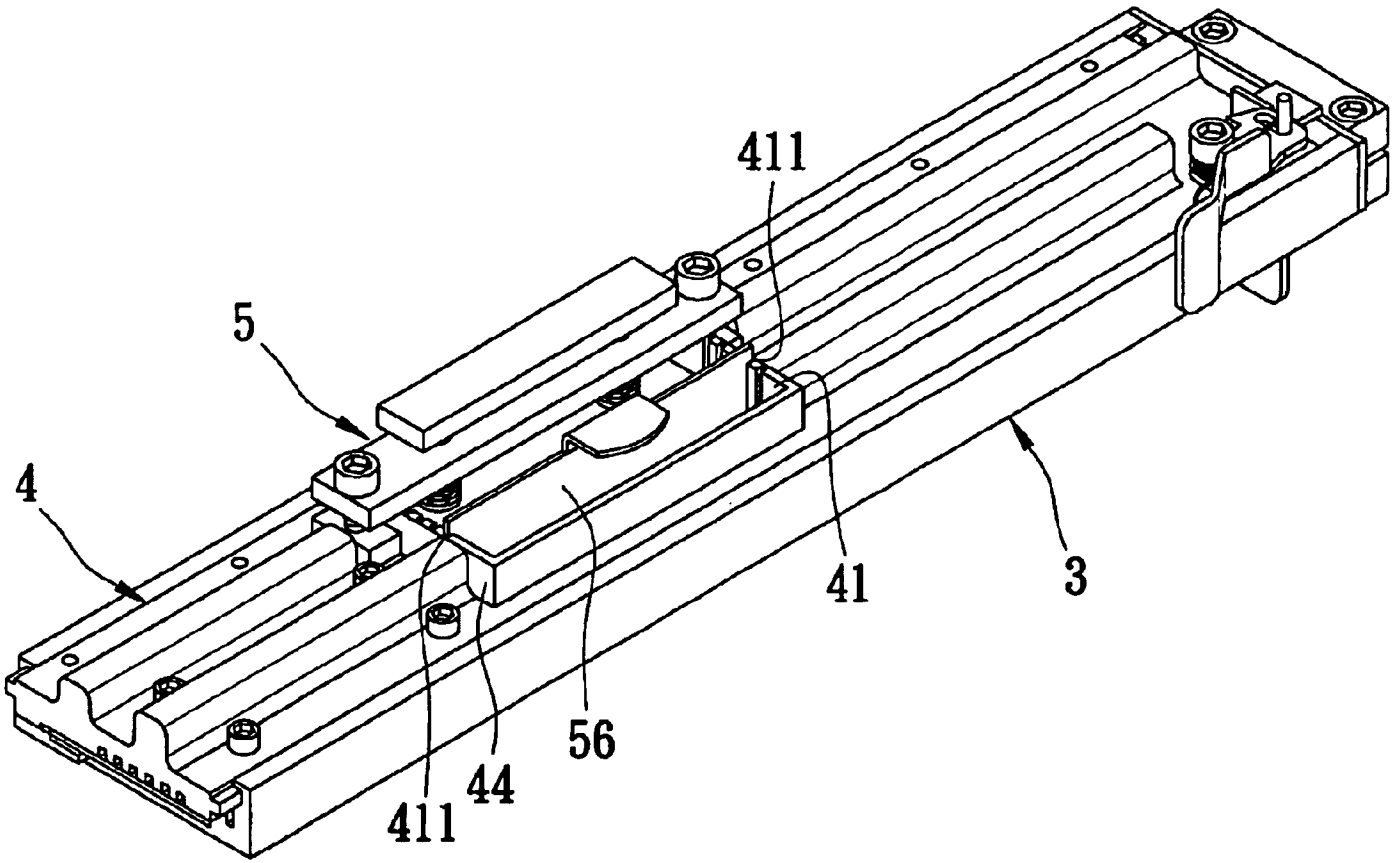
FIG. 14 is a perspective view of the fifth preferred embodiment.

Referring to FIGS. 13 and 14, the fifth preferred embodiment of a magazine according to this invention is shown to be similar to the third embodiment in construction, except that the separating member 7 has an engaging protrusion 73 which protrudes towards the elongated channel 31, and which is configured to engage the connecting end 651 of the gate plates 65 so as to be moved with the gate plates 65 in the advancing and retracting courses. In addition, the inner peripheral wall 44 of the nail-supplying member 4 has a plurality of insert grooves 411 formed in two opposite wall portions thereof. The nail-depressing member 5 further includes a partition plate 56 which can be inserted into two corresponding ones of the insert grooves 411 so as to partition the stacking opening 41 into two chambers that are opposite to each other in the axial direction for accommodating nails of different lengths.

As illustrated, by pulling the gate member 6 and the separating member 7, the stacked layers of nails 2,9 can be loaded smoothly into the elongated channel 31 one by one. The stacking opening 41 can accommodate a relatively large amount of nails 2,9 so as to facilitate use of the powered nail-driving tool.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A magazine for a powered nail-driving tool which defines a stroke path in an axial direction along which a nail that is fed thereinto is impacted, said magazine being capable of accommodating stacked multiple layers of a plurality of nails arranged in tandem, said magazine comprising:

a feeding tray which includes a standby zone adapted to support a lowermost one of layers of nails that are to be fed into the stroke path, and a retreat zone opposite to said standby zone in a longitudinal direction, said feeding tray being adapted to be secured to the powered nail-driving tool such that the longitudinal direction is radial to the axial direction, and such that said standby zone and said retreat zone are respectively proximate to and distal from the stroke path, said standby zone extending to terminate at a feeding front edge that is adapted to stop short of the stroke path, said feeding tray further including a loading zone which is adapted to receive the lowermost one of the layers of nails, which is interposed between said standby zone and said retreat zone, and which has placement and holding areas opposite to each other in the axial direction;

a gate member which is slidably disposed on said feeding tray, and which is displaceable among said standby zone, said loading zone and said retreat zone such that displacement of said gate member from said loading zone to said retreat zone in a retracting course permits loading of the lowermost one of the layers of nails into said loading zone, said gate member including pushing and connecting ends opposite to each other in the longitudinal direction, said pushing end being adapted to urge the lowermost one of the layers of nails towards said feeding front edge once loading on said loading zone is completed;

a pull member disposed to pull said gate member from said standby zone through said loading zone to said retreat zone;

a biasing member disposed to bias said gate member towards said standby zone to thereby urge a leading one of the nails in the lowermost one of the layers of nails into the stroke path;

a nail-supplying member disposed over said feeding tray, and having upper and lower wall surfaces opposite to each other in a transverse direction transverse to the axial and longitudinal directions, said upper wall surface defining a stacking opening which extends downward through said lower wall surface so as to be communicated with said feeding tray, which is adapted to accommodate the stacked multiple layers of nails, and which is registered with said loading zone so as to form a lowering path in the transverse direction; and a separating member which is interposed between said nail-supplying member and said gate member, and which is movable relative to said nail-supplying member in the longitudinal direction, said separating member being disposed to couple with said gate member so as to be moved therewith in an advancing course, where said gate member is displaced from said loading zone to said standby zone to urge the lowermost one of the layers of nails to said standby zone, and in the retracting course of said gate member, said separating member being configured such that during the retracting course of said gate member, said separating member is brought to move with said gate member away from said lowering path to said retreat zone, and such that during the advancing course, said separating member is brought to move with said gate member so as to slide underneath and support the remaining layers of nails in place of said gate member that supports the remaining layers of nails when in said loading zone.

2. The magazine of claim 1, further comprising a nail-depressing member which is disposed on said nail-supplying member and which is adapted to depress the stacked multiple layers of nails accommodated in said stacking opening in the transverse direction.

3. The magazine of claim 2, wherein said feeding tray is formed with an elongated channel that is elongated in the longitudinal direction and that includes said standby zone, said loading zone and said retreat zone, said gate member being slidable along said elongated channel.

4. The magazine of claim 3, wherein said separating member is formed as a plate, and has a plurality of keyways which extend in the longitudinal direction and each of which has first and second limit ends respectively proximate to and distal from said feeding front edge, said connecting end of said gate member having a plurality of keys which are disposed in and which are slidable along said keyways, respectively, such that when said gate member is in said standby zone, said keys reach said first limit ends of said keyways and said separating member is disposed underneath said stacking opening, and such that during the retracting course of said gate member, said keys reach said second limit ends of said keyways and said separating member is moved with said gate member away from said stacking opening so as to permit the remaining layers of nails on said separating member to move into said loading zone along the lowering path.

5. The magazine of claim 4, wherein said separating member has a front edge portion which is adjacent to said first limit ends of said keyways and which has a plurality of slide inclinations that are inclined from said front edge portion towards said elongated channel so as to facilitate movement of the remaining layers of nails along the lowering path.

6. The magazine of claim 3, wherein said separating member has an engaging protrusion which protrudes towards said elongated channel and which is configured to engage said connecting end of said gate member so as to be moved with said gate member in the advancing and retracting courses.

7. The magazine of claim 3, wherein said pull member includes a plurality of connecting rods, each having a first rod end secured to said connecting end of said gate member, and a second rod end extending in the longitudinal direction outwardly of said retreat zone, and an operating block connected to said second rod ends of said connecting rods so as to be operable to pull said gate member towards said retreat zone against biasing action of said biasing member.

8. The magazine of claim 7, wherein said biasing member includes a plurality of springs surrounding said connecting rods, respectively, and disposed between said connecting end of said gate member and said retreat zone to bias said gate member towards said standby zone.

9. The magazine of claim 8, wherein said gate member includes a plurality of gate plates extending in the longitudinal direction so as to be connected to said first rod ends of said connecting rods, respectively, and to be biased by said springs, respectively.

10. The magazine of claim 2, wherein said nail-depressing member includes a cover plate which is mounted on said upper wall surface of said nail-supplying member and which covers said holding area, a depressing plate which is spaced apart from and which is movable relative to said cover plate in the transverse direction, a biasing member disposed between said cover plate and said depressing plate to bias said depressing plate towards said holding area so as to abut against the stacked layers of nails in said stacking opening, and a pulling plate which is coupled with said depressing plate to pull said depressing plate away from said holding area against biasing action of said biasing member for facilitating filling of the nails into said stacking opening.

11. The magazine of claim 10, wherein said nail-depressing member further includes a partition plate which is disposed in said stacking opening to partition said stacking opening into two chambers that are opposite to each other in the axial direction and that are adapted to accommodate nails of different lengths.

12. The magazine of claim 10, wherein said nail-supplying member has an inner peripheral wall extending between said upper and lower wall surfaces and defining said stacking opening, said inner peripheral wall having a guiding wall surface which extends from said cover plate toward said holding area and which is distal from said placement area in the axial direction, said guiding wall surface having an abutment region which is inclined towards said holding area such that during loading of the lowermost one of the layers of nails into said loading zone, the remaining ones of the layers of nails are successively shifted back against said abutment region following inclination of said abutment region while being under the pressure of said depressing plate, thereby stabilizing stacking of the layers of nails.

* * * * *